US006527216B2

(12) United States Patent
Eagelman et al.

(10) Patent No.: US 6,527,216 B2
(45) Date of Patent: Mar. 4, 2003

(54) ELECTRONIC LENGTH CONTROL WIRE PAY-OFF SYSTEM AND METHOD

(75) Inventors: John M. Eagelman, Sinking Spring, PA (US); William M. Ledbetter, Sinking Spring, PA (US)

(73) Assignee: Magnatech International LLP, Robisonia, PA (US)

( * ) Notice: Subject to any disclaimer, the term of this patent is extended or adjusted under 35 U.S.C. 154(b) by 0 days.

(21) Appl. No.: 10/140,388

(22) Filed: May 7, 2002

(65) Prior Publication Data

US 2002/0166917 A1 Nov. 14, 2002

Related U.S. Application Data

(60) Provisional application No. 60/289,575, filed on May 8, 2001.

(51) Int. Cl.[7] ..... B65H 59/36; B65H 23/06

(52) U.S. Cl. ..... 242/417.3; 242/131; 242/147 M; 242/421.7

(58) Field of Search ..... 242/417.3, 421.6, 242/421.7, 128, 147 M, 131, 156; 226/43, 45

(56) References Cited

U.S. PATENT DOCUMENTS

| | | | | |
|---|---|---|---|---|
| 3,498,553 A | * | 3/1970 | Lee | 242/147 M |
| 3,717,313 A | * | 2/1973 | Williams | 242/421.6 |
| 3,839,939 A | | 10/1974 | Wily | |
| 3,907,229 A | | 9/1975 | Iannucci et al. | |
| 4,151,594 A | * | 4/1979 | Stern | 242/421.7 |
| 4,203,046 A | * | 5/1980 | Homann et al. | 310/105 |
| 4,529,147 A | | 7/1985 | Bull et al. | |
| 4,623,101 A | * | 11/1986 | Cacak | 242/413.5 |
| 5,524,834 A | * | 6/1996 | Bogucki-Land | 242/147 M |
| 6,186,434 B1 | * | 2/2001 | Mitsuhashi | 242/147 M |

* cited by examiner

*Primary Examiner*—Michael R. Mansen
(74) *Attorney, Agent, or Firm*—Duane Morris LLP

(57) ABSTRACT

A multi-spindle fiber pay-out apparatus is provided that allows for fiber tension control. A frame supports a plurality of spools of fiber, with each spool of fiber being mounted on a spindle. The spindle is in rotational supporting relation to the spool of fiber and is operatively engaged with a magnetic particle brake, which is itself in control communication with an electronic controller. A fiber take-up system is mounted upon the frame in cooperative relation to the spool of fiber and is arranged so as to compensate for changes in the fiber-pay-out rate from the spool of fiber that are caused by activation/deactivation of the magnetic particle brake. A load cell transducer is mounted on the frame adjacent to the fiber take-up system. The load cell transducer is at least partially engaged by a fiber, and is arranged in electrical data communication with the magnetic particle brake so as to (i) activate the magnetic particle brake when a tension in the fiber is detected below a predetermined magnitude, and (ii) deactivate the magnetic particle brake when the tension in the fiber is at or above the predetermined magnitude. A method is also provided for monitoring and adjusting the length of a fiber via monitoring of the tension in the fiber.

18 Claims, 9 Drawing Sheets

ELECTRONIC LENGTH CONTROL WIRE PAY-OFF SYSTEM AND METHOD

This application claims priority from Provisional Patent Application Serial No. 60/289,575, filed May 8, 2001, entitled Magna-ELC.

FIELD OF THE INVENTION

The present invention relates to an apparatus for feeding multiple fibers to a winding machine or the like and, more particularly, to such apparatus wherein the tension in each fiber is monitored and controlled so as to prevent the fiber from sagging as it traverses the distance from a spool to the winding machine.

BACKGROUND OF THE INVENTION

Winding machines adapted to wrap a plurality of strands of fiber or wire into a completed product or onto a core member that is being drawn through a winding machine are well known in the art. The strands of fiber that are to be applied in this way are often supplied to such machines from a separate apparatus including a plurality of spools of fiber. Associated with each spool of fiber is a strand delivery assembly which often includes both a mechanical tension controlling mechanism and a clutch mechanism. The tension controlling mechanism functions to maintain a constant tension on the strand of fiber as it leaves the spool. When a constant or near constant tension is not maintained in each fiber as it makes its way to the winding machine, a difference in length is created between fibers which greatly degrades the quality of the winding on the end product.

In prior art fiber pay-out apparatus, the tension control mechanism is often engaged by means of a clutch mechanism that restrains the spool from rotating and dispensing a strand of fiber and periodically releases the spool when the tension controlling mechanism reaches the limit of its operation. Release of the spool permits an additional length of fiber to be unwound from the spool. These prior art tension control mechanisms have provided less than desirable results. In particular, prior art fiber or wire pay-out systems have suffered from a lack of accurate and precise control of the tension in each fiber due, in part, to the lack of an adequate real-time control of the interaction between the tension control mechanism and the clutch mechanism. A tension control system is needed that allows for the monitoring of fiber tension, and a feed-back loop control over the release of fiber from a spool.

SUMMARY OF THE INVENTION

The present invention provides a multi-spindle fiber pay-out apparatus that provides fiber tension control. In a preferred embodiment, a frame supports a plurality of spools of fiber, with each spool of fiber being mounted on a spindle having a first end and a second end. The first end of the spindle is in rotational supporting relation to the spool of fiber and the second end is operatively engaged with a magnetic particle brake, which is itself in control communication with an electronic controller. A fiber take-up system is mounted upon the frame in cooperative relation to the spool of fiber and arranged so as to compensate for changes in the fiber pay-out rate from the spool of fiber that are caused by activation/deactivation of the magnetic particle brake, or inherent irregularities in the fiber coming from the spool. A load cell transducer is also mounted upon the frame, adjacent to the fiber take-up system. The load cell transducer is at least partially engaged by a fiber, and is arranged in electrical data communication with the magnetic particle brake so as to (i) activate the magnetic particle brake when a tension in the fiber is detected below a predetermined magnitude, and (ii) deactivate the magnetic particle brake when the tension in the fiber is at or above the predetermined magnitude. A method for monitoring and adjusting the length of a fiber via monitoring of the tension in the fiber is also provided in which a continuous length of fiber is paid-out so as to continuously engage a rotating portion of a load cell transducer. The magnitude of the load applied to the load cell transducer by the fiber is compared to a standard. When a load is detected by the load cell transducer that is below the standard, means for retarding the pay-out of fiber are activated. When the load is at or above the standard the means for retarding the pay-out of fiber is deactivated.

BRIEF DESCRIPTION OF THE DRAWINGS

These and other features and advantages of the present invention will be more fully disclosed in, or rendered obvious by, the following detailed description of the preferred embodiment of the invention, which is to be considered together with the accompanying drawings wherein like numbers refer to like parts and further wherein.

DETAILED DESCRIPTION OF THE PREFERRED EMBODIMENT

Figure 1:
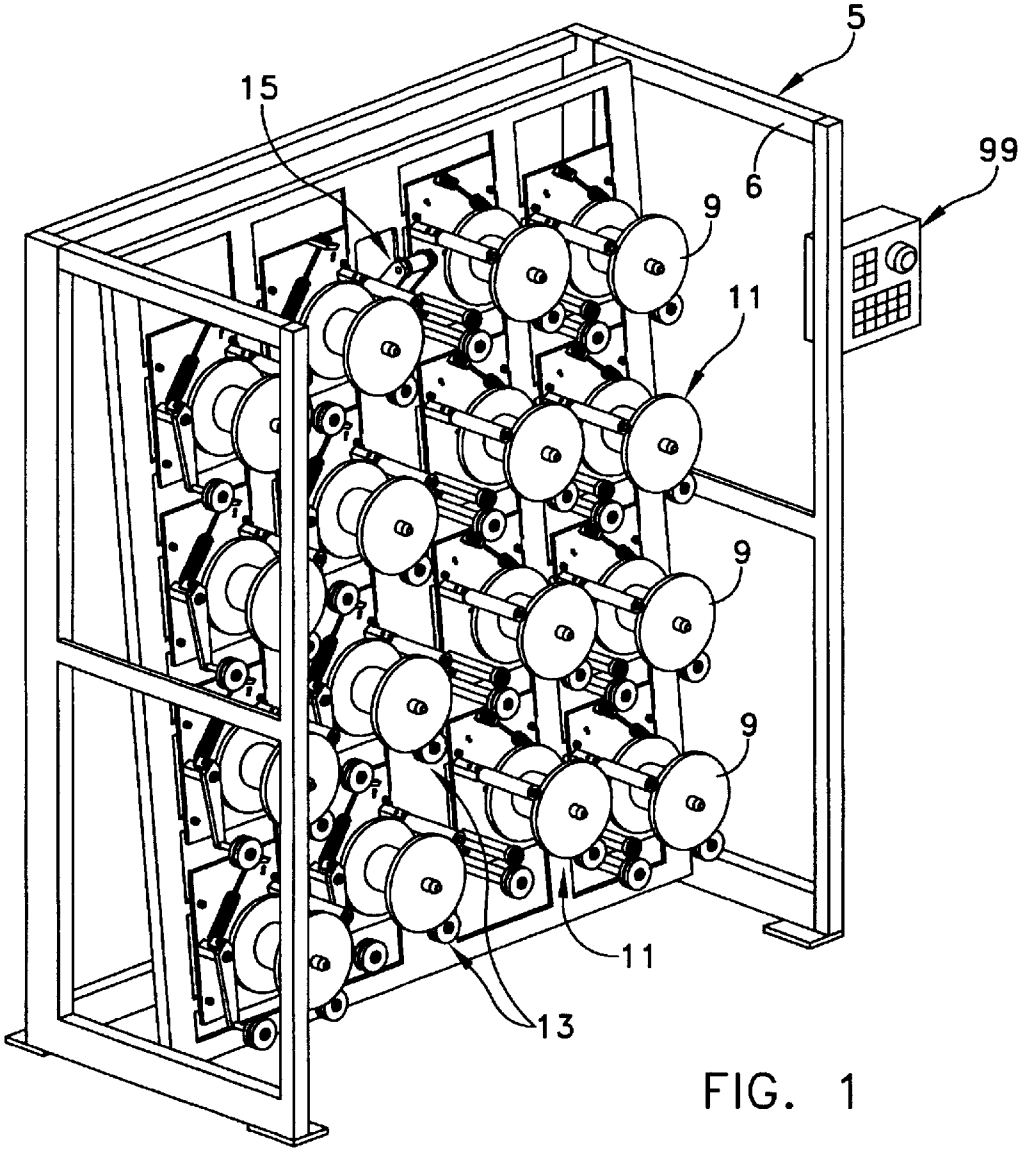
FIG. 1 is a perspective view of a multi-spindle fiber pay-out apparatus, formed in accordance with the present invention.
Figure 2:
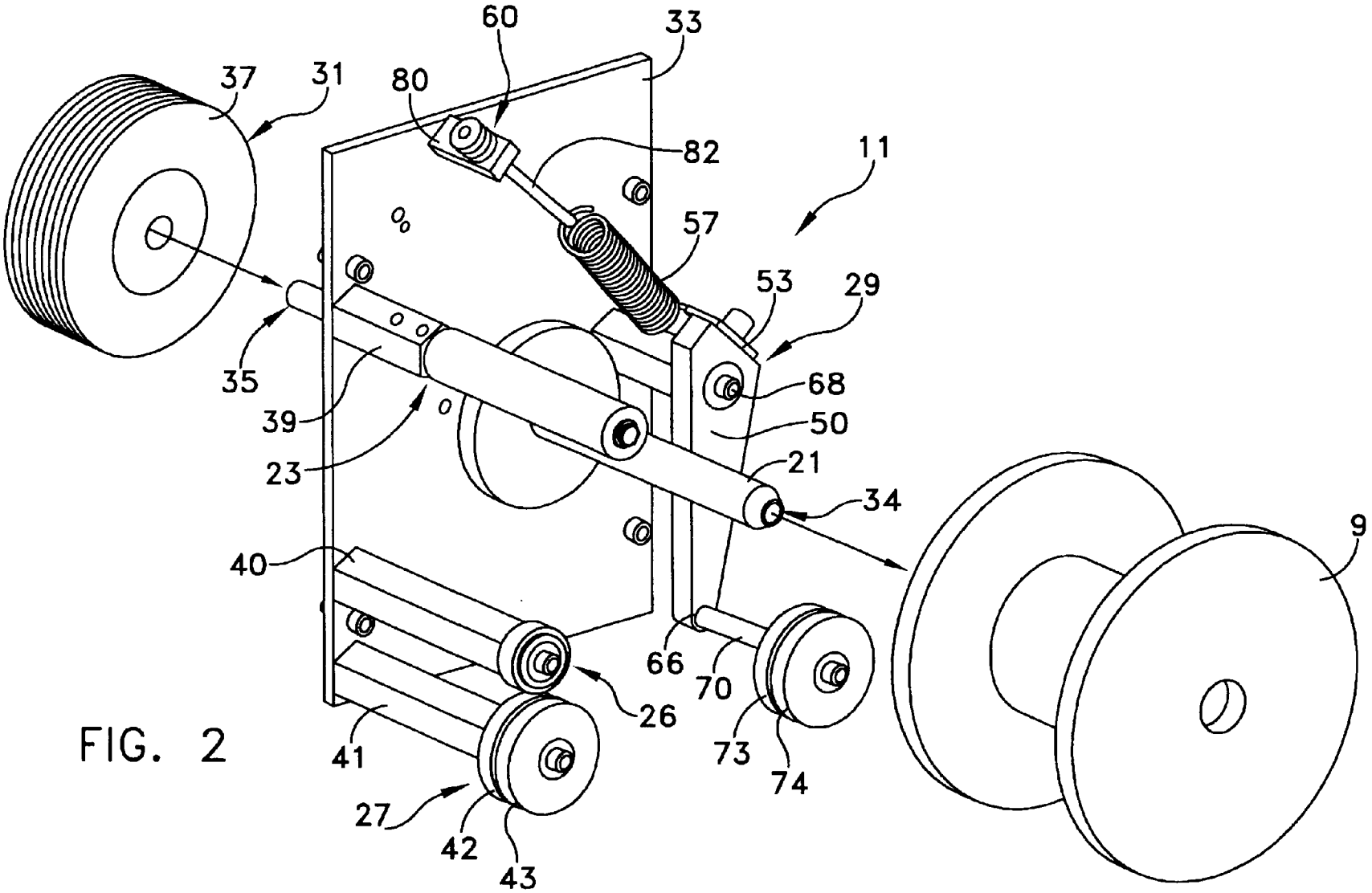
FIG. 2 is a partially exploded perspective view of a spindle assembly formed in accordance with the present invention.

This description of preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively, connected" or "operatively mounted" is such an attachment, coupling or connection that allows the pertinent structures to operate as intended by virtue of that relationship. In the claims, means-plus-function clauses are intended to cover the structures described, suggested, or rendered obvious by the written description or drawings for performing the recited function, including not only structural equivalents but also equivalent structures.

Figure 4:
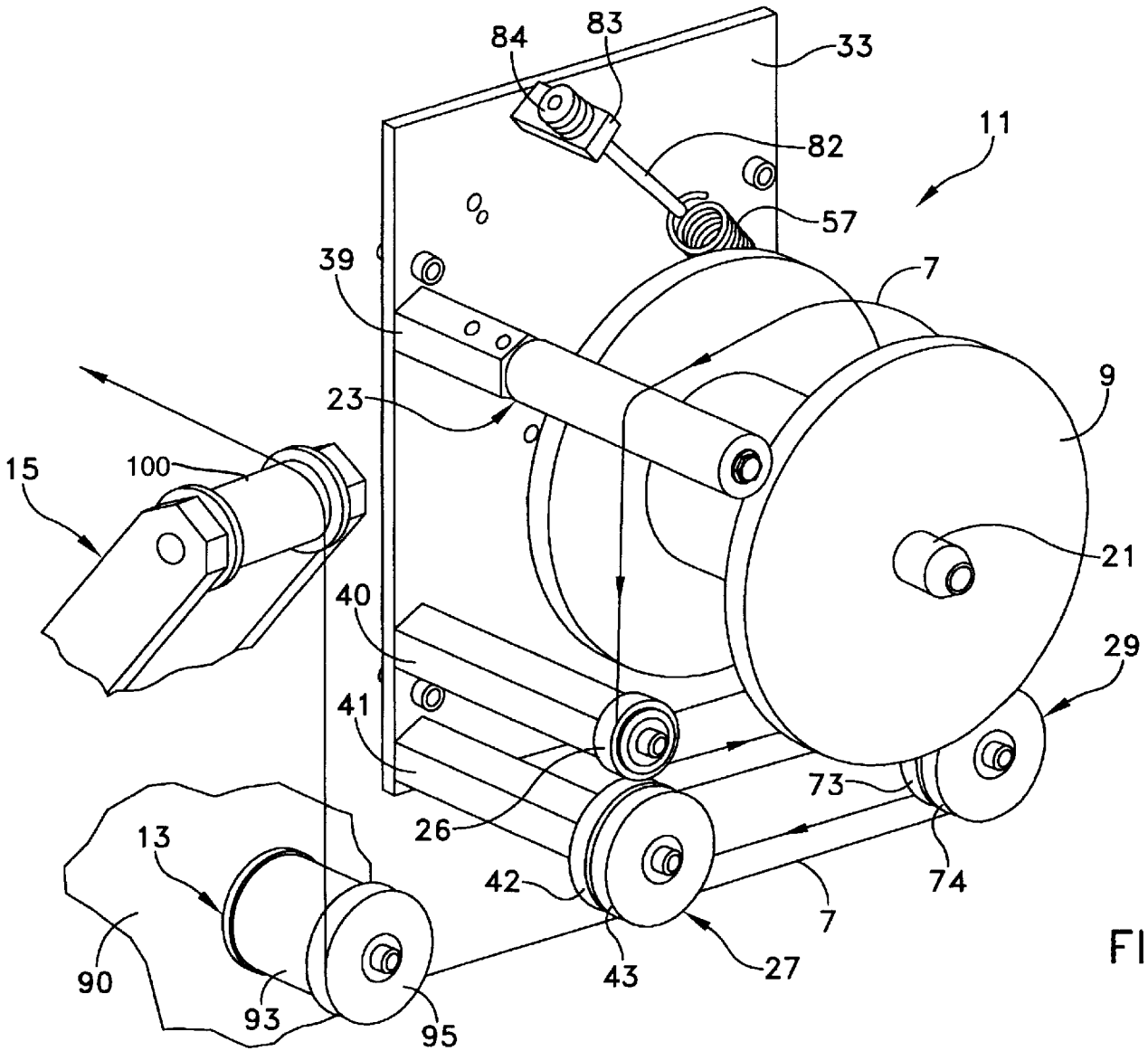
FIG. 4 is a perspective view of the spindle assembly shown in FIG. 2.

Referring to FIG. 1., the present invention comprises a multi-spindle pay-out stand 5 that is designed to precisely and accurately control the tension in individual strands of fiber 7 (FIG. 4) as each is paid-out from a respective bulk supply spool 9 and fed into a conventional winding machine (not shown). Very often fiber 7 is in the form of metal wire, however, other nonmetal fibers may also be used in connection with the present invention. Multi-spindle pay-out stand 5 comprises a frame 6 that is constructed to support a plurality of spindle assemblies 11, a plurality of load cell assemblies 13, and a plurality of wire exit guide assemblies 15.

Referring to FIGS. 1–4, each spindle assembly 11 provides a fiber take-up/pay-out system during operation of multi-spindle pay-out stand 5, and includes a spindle 21, a baler roller 23, a first guide roller 26, a second guide roller 27, a dancer assembly 29, and a magnetic particle brake assembly 31. Spindle 21 is often formed from an elongate cylindrical rod that is operatively mounted to a spindle assembly support plate 33 so that a first end 34 is positioned in spaced, perpendicular relation to a front surface of spindle assembly support plate 33 and a second end 35 is positioned in spaced, perpendicular relation to a rear surface of spindle assembly support plate 33. Conventional retaining rings and ball bearings (not shown) operatively interconnect spindle 21 with spindle assembly support plate 33. A releasable spool lock mechanism 36 operatively connects bulk supply spool 9 to spindle assembly 11 so that, as fiber 7 is pay-out from spool 9, spindle 21 rotates in unison with spool 9. Thus, when spindle 21 is stopped from rotating, spool 9 also ceases rotation. A magnetic particle brake 37 is positioned adjacent to the rear surface of spindle assembly support plate 33 in engaged, controlling relation to second end 35 of spindle 21. Magnetic particle brake 37 provides means for the controlled retarding of the pay-out of fiber 7 from bulk supply spool 9, as will hereinafter be disclosed in further detail.

It will be understood that a conventional magnetic particle brake 37 of the type suitable for use with the present invention will comprise a rotor that is contained within a brake housing body and attached to end 35 of spindle 21. A gap will exist between the rotor and the side of the brake housing body. A magnetic powder is positioned within the gap so that when this magnetic powder is acted upon by an induced magnetic field, generated by external control means of the type that are well known in the art, variations in the viscosity of the magnetic powder are created within the gap. These variations in viscosity provide for control of the torque transmission between the brake housing and end 35 of spindle 21.

Three fixed stand-off shafts 39, 40, 41 project outwardly from the front surface of spindle assembly support plate 33. Fixed stand-off shaft 39 rotatingly supports baler roller 23, fixed stand-off shaft 40 rotatingly supports first guide roller 26 and fixed stand-off shaft 41 rotatingly supports second guide roller 27. Baler roller 23 is positioned above spindle 21 on fixed stand-off shaft 39, with first guide roller 26 being positioned below spindle 21 and above second guide roller 27 along an edge of spindle assembly support plate 33. Baler roller 23 comprises an elongate cylindrical tube that is arranged so as to rotate upon a central coaxial shaft portion of fixed stand-off shaft 39. First guide roller 26 comprises a single, circumferentially grooved wheel or "sheave" that is mounted on the end of fixed stand-off shaft 40, and second guide roller 27 comprises two ceramic sheaves 42,43 positioned, side-by-side, on a central coaxial shaft portion that projects outwardly from an end of fixed stand-off shaft 41.

Dancer assembly 29 provides an adjustably biased tensioning system that is mounted to the front surface of spindle assembly support plate 33, and comprises a dancer arm 50, a dancer spring clasp 53, a dancer arm spring 57 and a spring adjustment assembly 60. Dancer arm 50 comprises a shaft that includes a pivot hole 62 defined through a first end, and a roller shaft hole 66 defined through as second end. Pivot hole 62 and roller shaft hole 66 are arranged in spaced relation to one another. Dancer spring clasp 53 is mounted to the first end of dancer arm 50, and includes an opening that is sized and shaped to receive and engage an end portion of dancer spring 57. A pivot pin 68, that projects outwardly from the front surface of spindle assembly support plate 33, is received within pivot hole 62 of dancer arm 50 so that dancer arm 50 is pivotally mounted to spindle assembly support plate 33, in spaced relation to spindle 21. An end of an elongate roller shaft 70 is mounted within roller shaft hole 66 so that roller shaft 70 projects outwardly in perpendicular relation to the end of dancer arm 50. A pair of ceramic guide rollers (sheaves) 73, 74 are rotatingly mounted to the free end of roller shaft 70.

Spring adjustment assembly 60 is mounted to the front surface of spindle assembly support plate 33, and includes a tension adjust block 80, an adjust rod 82, and a thumb knob 84. Tension adjust block 80 is securely mounted to spindle assembly support plate 33 above spindle 21 and typically comprises an "L" bracket or the like having a through-hole that is positioned in spaced relation to the surface of spindle assembly support plate 33. Adjust rod 82 is an elongate, threaded shaft that includes a through-bore 89 at one end that is sized and shaped to receive and engage an end portion of dancer spring 57. Adjust rod 82 is threadingly positioned within the through-hole of tension adjust block 80 with thumb knob 84 operatively attached to one end and dancer spring 57 engaged with through-bore 89.

Figure 3:
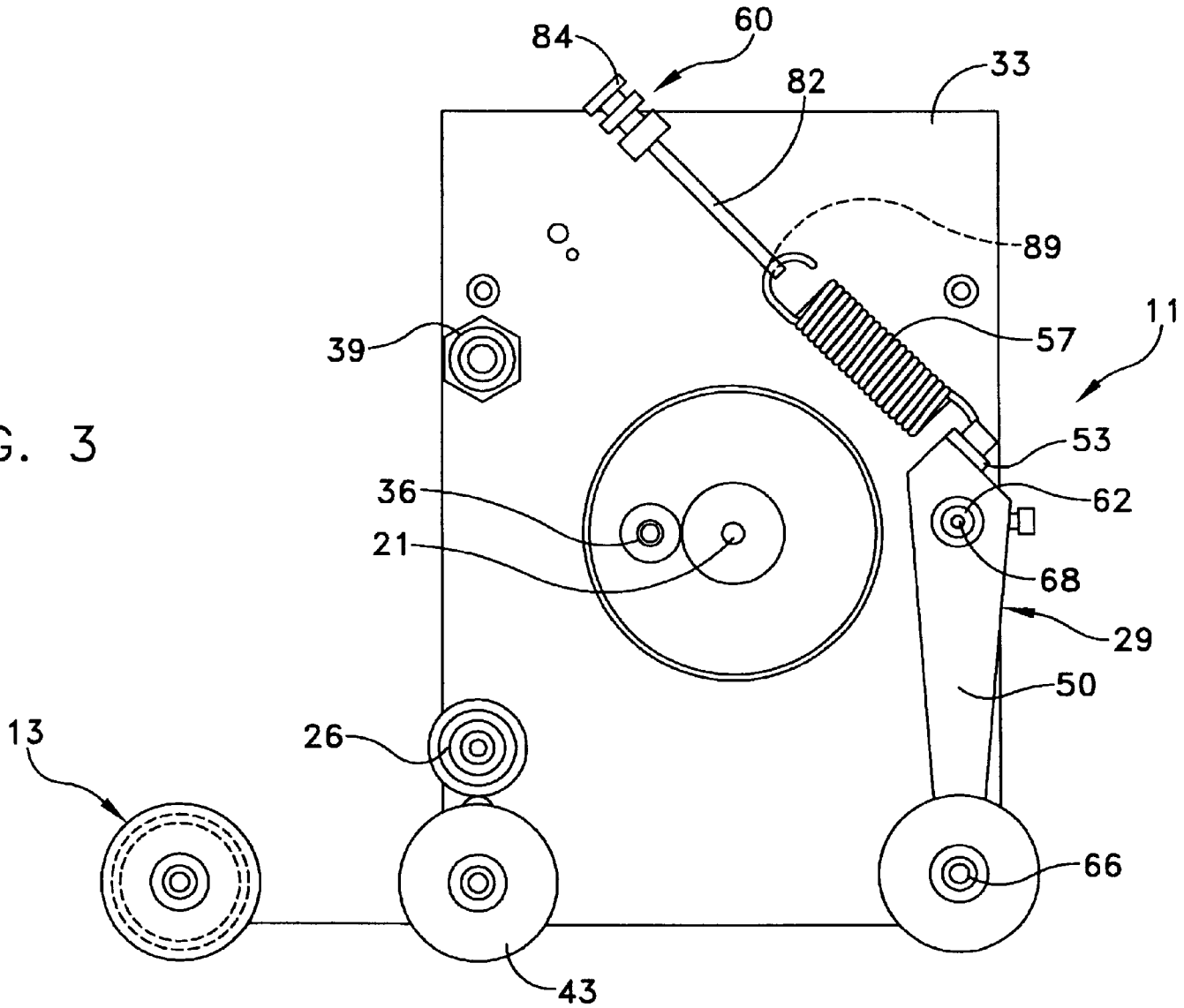
FIG. 3 is a front elevational view of the spindle assembly shown in FIG. 2.
Figure 8:
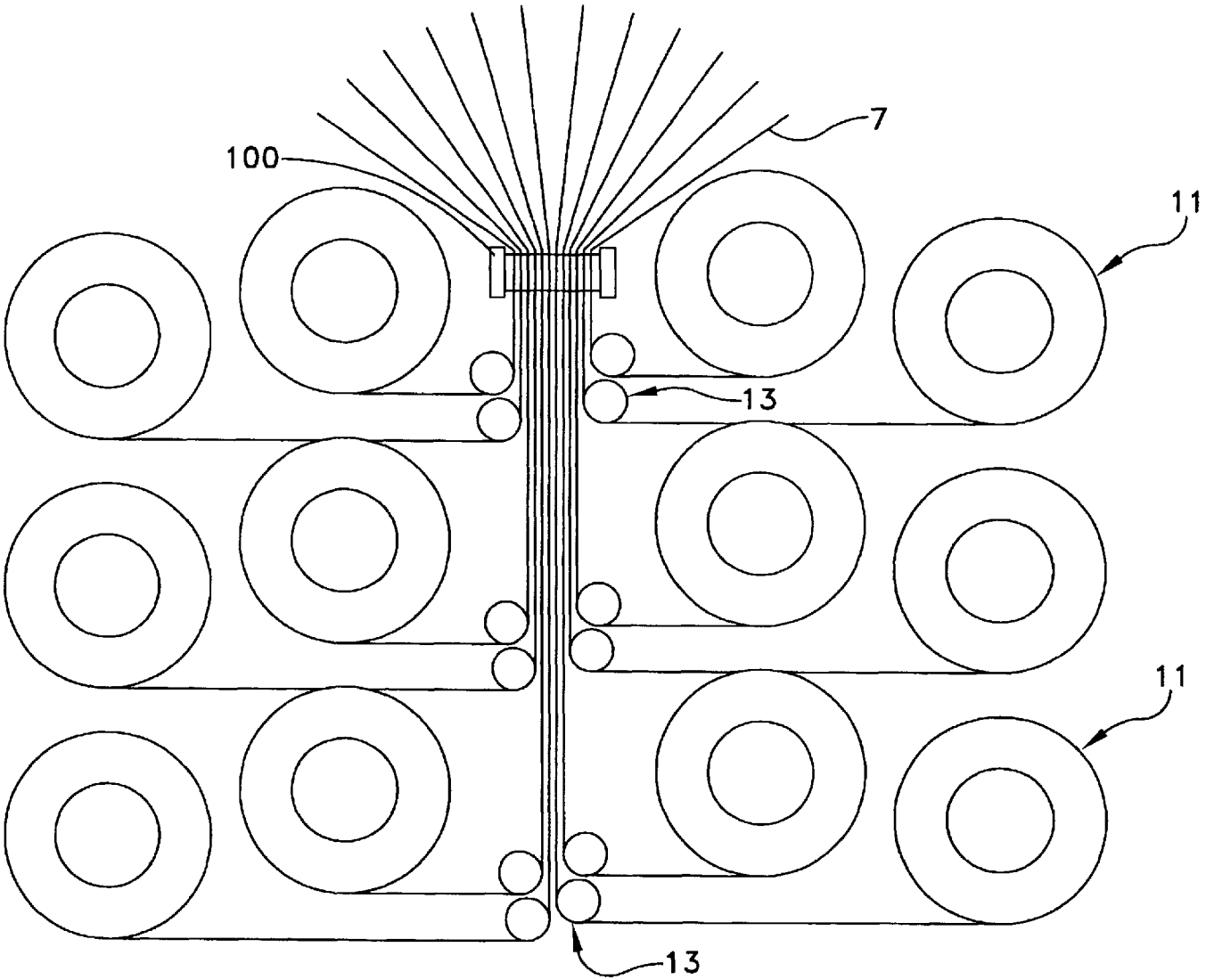
FIG. 8 is a schematic representation of a plurality of bulk supply spools arranged such that a fiber from each spool is engaged with a representation of a load cell and a fiber exit roller.

Multi-spindle pay-out stand 5 utilizes a double threading technique to cushion fluctuations and maintain consistent fiber tension throughout the entire winding cycle. Each fiber 7 is threaded through spindle assembly 11 in the following manner. A bulk supply spool 9 is placed onto spindle 21 so that fiber 7 will pay-out from the top of spool 9 and over the top of baler roller 23 (FIG. 3). Fiber 7 is then wrapped over baler roller 23 and under first guide roller 26. It is then drawn toward and around ceramic guide roller 73 on the end of dancer arm 50. Fiber 7 is then wrapped under and around ceramic sheave 42 and drawn back toward ceramic guide roller 74 on dancer arm 50. Fiber 7 wraps around ceramic guide roller 74 and comes off tangent to the bottom of roller 74 and out around the bottom of sheave 43 on the outside end of second guide roller 27. The length of fiber 7 is then drawn toward load cell assembly 13. The foregoing steps are then repeated for each of the spindle assemblies 11. When winding less than 12 fibers from multi-spindle pay-out stand 5, it has been found advantageous to mount spools 9 on spindles 21 starting from the inside and progressing outward, one at a time, using left and right spindles (FIGS. 1 and 8).

Figure 5:
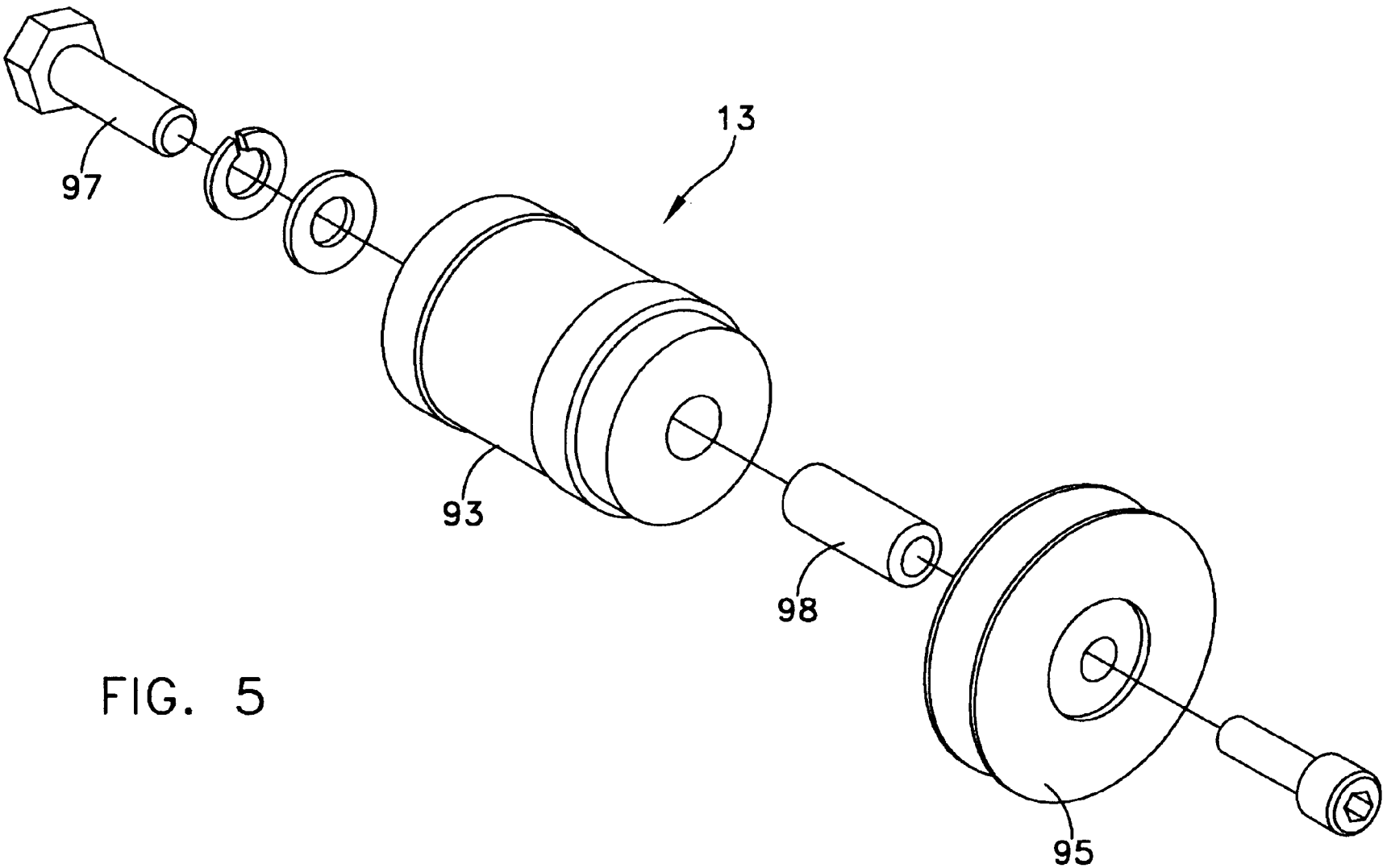
FIG. 5 is an exploded perspective view of a load cell assembly.
Figure 6:
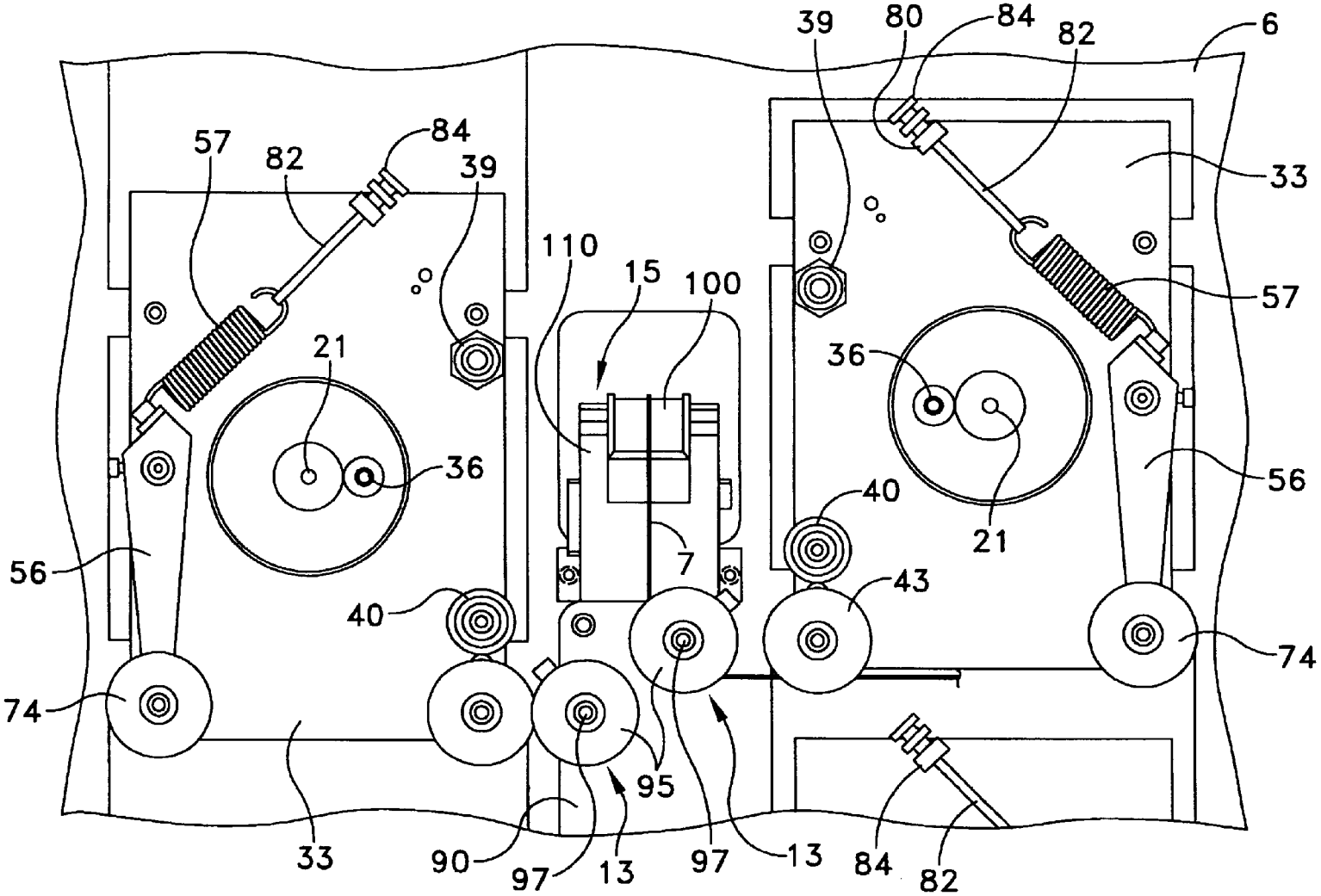
FIG. 6 is a broken-away, front elevational view of adjacent spindle assemblies, and including a front elevational view of a load cell assembly and wire exit guide assembly.
Figure 7:
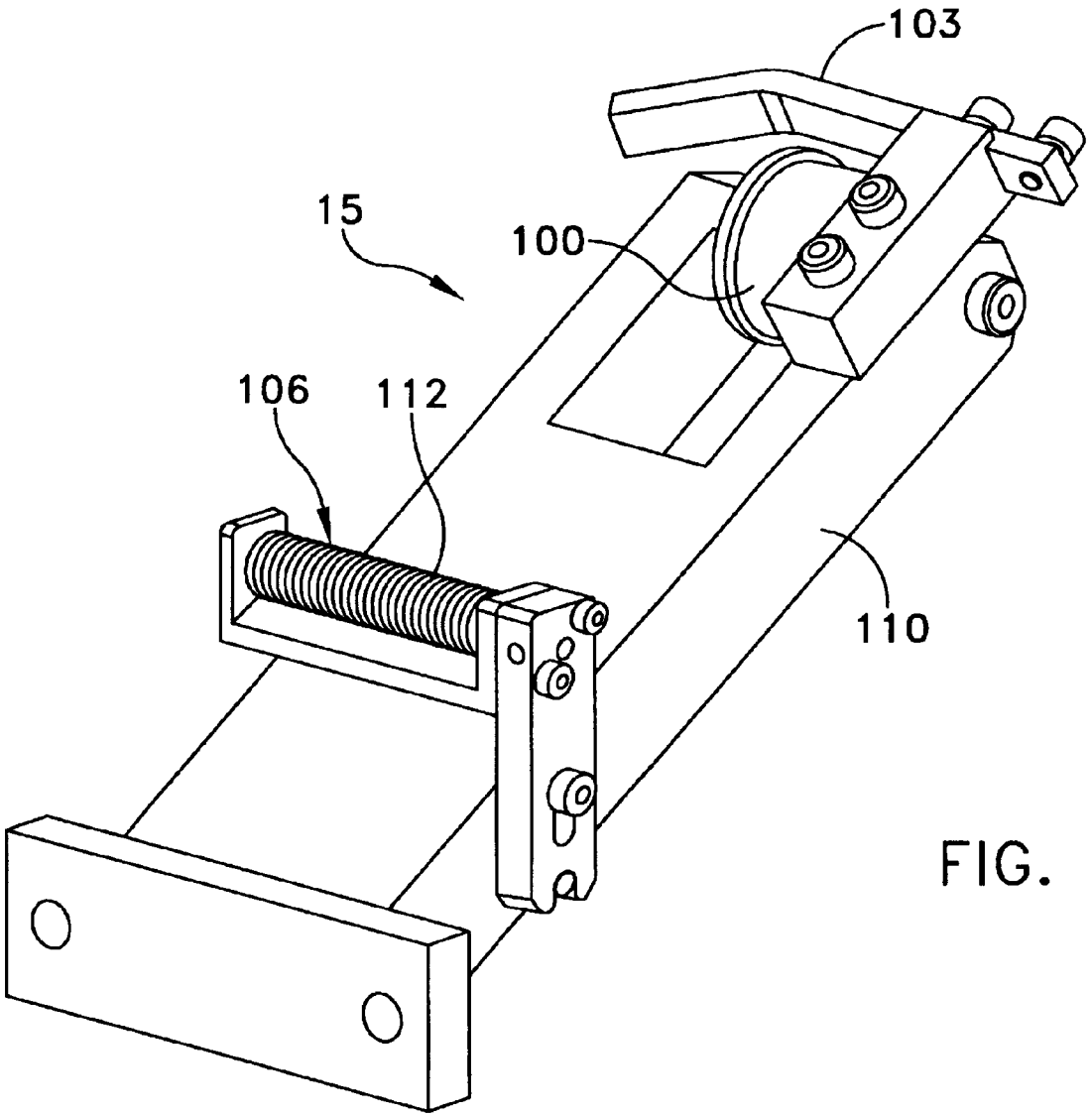
FIG. 7 is a perspective rear view of a wire exit guide assembly.

Referring to FIGS. 5–7, a plurality of load cell assemblies 13 are mounted to a central portion of multi-spindle pay-out stand 5 so that one load cell assembly 13 is associated with each bulk supply spool 9. Each load cell assembly 13 includes a load cell mounting plate 90, a load cell transducer 93, and ceramic guide sheave (roller) 95. More particularly, load cell mounting plate 90 includes a pair of support shafts 97 that project outwardly form a top surface so as to provide support for load cell transducer 93 and ceramic guide sheave 95. Ceramic guide sheave 95 is rotatingly mounted to one end of load cell transducer 93 so as to be in spaced coplanar relation to second guide roller 27 and ceramic sheaves 42,43 of spindle assembly 11. Preferably, ceramic guide sheave 95 is sized and shaped such that fiber 7 engages no more than a 90° segment. Load cell transducer 93 may comprise any of the known sensors that are capable of measuring the deflection of a central load cell shaft 98 passing through the transducer, where the magnitude of that deflection is proportional to the force being applied to the shaft. For example, one load cell transducer arrangement that has been found to provide adequate results in use with the present invention is a Cleveland Motion Controls Company transducer-model No.: TNSC-IT-10 and associated differential amplifier, power supply, and power regulator forming a comparison portion of electronic control means 99.

Figure 9:
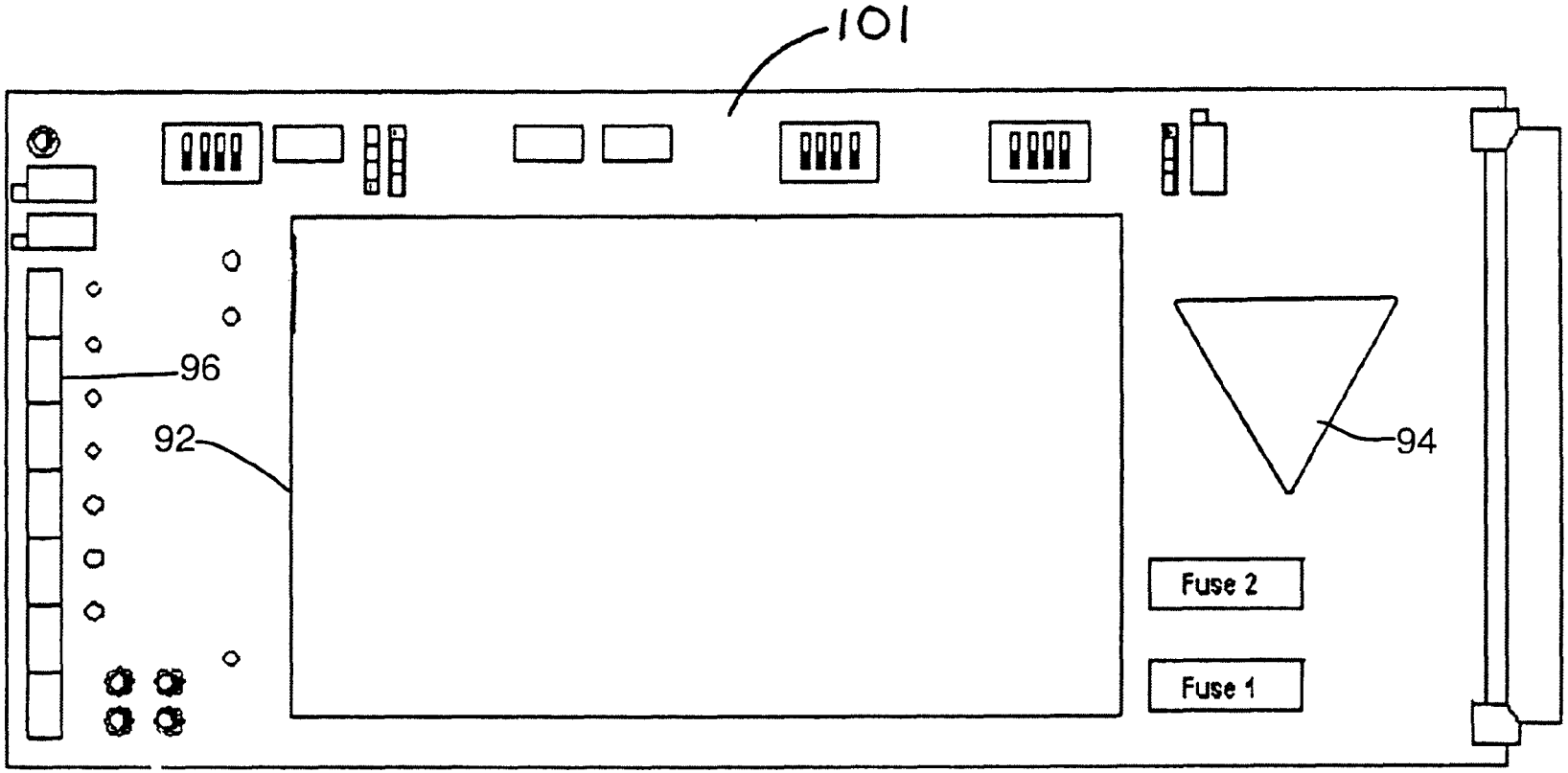
FIG. 9 is a schematic representation of a control circuit board used in connection with one embodiment of the invention.

More particularly, a PID control board designated a Merobel PLP05A, comprises a power conversion section 92, load cell amplification section 94, and a control regulation section 96 mounted on a single printed wiring board 101, that utilize known electrical and electronic components such as resistors, diodes, potentiometers, LED's and transistors to provide the electronic control and communication means necessary for operation of the present invention (FIG. 9). Power conversion section 92 performs two tasks. It takes input power (24 volts, AC or DC) and reduces the voltage to a low level for the electronics in load cell amplification section 94 and control regulation section 96. It also electronically communicates with, and provides power to magnetic particle brake 37 in accordance with results from control regulation section 96.

Load cell amplification section 94 provides the very low voltage levels required for proper functioning of load cell transducer 93. However, these voltages need to be increased in order for control regulation section 96 to function properly. Load cell amplification section 94 takes the input from load cell transducer 93 (40 to 450 millivolts) and increases the voltage to TTL level signals (+/−5 VDC) for use by control regulation section 96.

Control regulation section 96 compares the tension setpoint (the predetermined, standard magnitude of the load applied to load cell transducer 93) against the actual tension applied to load cell transducer 93 by fiber 7. In response to the result of this comparison, control regulation section 96 communicates an adjustment in the power applied to magnetic particle brake 37 so as to (i) activate magnetic particle brake 37 when the tension in fiber 7 is below the tension setpoint, and (ii) deactivate magnetic particle brake 37 when the tension in fiber 7 is at or above the tension setpoint.

In operation, a desired tension setpoint is input to control regulation section 96 by an external potentiometer operated by a machine operator. The actual tension in fiber 7 is communicated to control regulation section 96 via load cell amplification section 94, by load cell transducer 93 that is mounted in the fiber path. Also included in control regulation section 96 are a series of potentiometers that provide a means for regulating the magnitude of the incremental adjustments made in the power delivered to magnetic particle brake 37 so as to "tune the loop" to obtain the optimum performance from multi-spindle pay-out stand 5. Too large an incremental adjustment of to magnetic particle brake 37, and the tension in fiber 7 becomes unstable, too little adjustment and the difference between the tension and the setpoint becomes too great. Control regulation section 96 also provides a means for calibrating load cell transducer 93 to a predetermined tension level. Also control regulation section 96 may include four or more indicators, e.g., LED's, to indicate status.

A Dover Flexo-FLRA-0-100-R6-6-SPR ribbon filament tension transducer connected to a Dover Flexo differential amplifier and other electronic control means 99 of the type well known in the art may also be used with adequate results for controlling and communicating with such load cell-transducers 93. Load cell transducer 93 is arranged in electrical data communication with electronic control means 99 via conventional electrical or optical data communications means of the type well known in the art for data communications between functioning portions of machinery.

Multi-spindle pay-out stand 5 is preferably calibrated for a maximum fiber tension of about 2.26 kilograms (5 pounds). It will be understood that exceeding the maximum tension can and will result in damage to the machine. A recommended maximum operating tension is about 1.86 kilograms (4 pounds). Each load cell's calibration is checked and verified using the following procedure. More particularly, a fiber has a predetermined weight (2.26 kilogram) attached to one end with the other end of the fiber secured to a fixed spool spindle 21. The fiber having a weight at the end is then threaded around its associated guide rollers, and around ceramic guide sheave 95 on the end of load cell transducer 93. Once in this position, with the weight hanging freely from ceramic guide sheave 95, a digital display on electronic control means 99 should indicate a load of 5 pounds. This process will then be repeated for all of the plurality of load cell assemblies 13 on multi-spindle pay-out stand 5. Electronic control means 99 will include up to twelve such digital displays, with a set of push-button potentiometers operatively arranged so as to adjust the value displayed. The potentiometers establish the predetermined magnitude of the tension on each fiber 7 emanating from a spindle 9. In typical bobbin winding applications, the most common strand tension is about 1 kilogram (2.5 pounds).

Referring to FIGS. 1 and 7, wire exit guide assembly 15 includes a guide roller 100, a broken wire contact bar 103, and a wire retention means 106 all mounted to a support bracket 110. Guide roller 100 is cylindrical, and is rotatingly mounted to the top portion of support bracket 110. Broken wire contact bar 103 is positioned on support bracket 110 so as to be adjacent to guide roller 100. In this way, if a metal wire is broken during operation it will engage broken wire contact bar 103 thereby completing a circuit that will either activate an alert signal or shut the machine down. Wire retention means 106 often comprises a helically wound spring 112 that is located on support bracket 110 below guide roller 100, and facing away from multi-spindle pay-out stand 5 (not seen in FIGS. 1 and 6). Wire retention spring 112 is sized and shaped so as to allow individual fibers to be slid between adjacent turns so as to be held in place while additional fibers are threaded through multi-spindle pay-out stand 5. Once the individual fibers from each bulk supply spool 9 are threaded through multi-spindle pay-out stand 5, and held in place between the turns of retention spring 112, they can be taken as a group from multi-spindle pay-out stand 5 to the winding machine that multi-spindle pay-out stand 5 is servicing (FIG. 8).

Multi-spindle pay-out stand 5 operates to accurately and precisely control the tension in individual strands of fiber 7 as each is paid-out from a respective bulk supply spool 9 and fed into a conventional winding machine in the following manner. If tension in fiber 7 is allowed to vary between fibers, the fibers having a lower tension will result in a longer length between guide roller 100 and the intake mechanisms to the winding machine (not shown). Multi-spindle pay-out stand 5 operates to minimize this effect by monitoring the tension of each individual fiber 7 through plurality of load cell assemblies 13.

More particularly, as fibers 7 are drawn from multi-spindle pay-out stand 5, each fiber engages ceramic guide sheave 95 of load cell transducer 93 and, therethrough, a measure of the force applied to load cell transducer 93 is communicated to electronic control means 99. This measure is then compared to the predetermined, standard tension required (e.g., a 1.86 kilogram load) by electronic comparison means resident in electronic control means 99, or other differential amplifier means. When the tension in fiber 7 is detected below that predetermined magnitude, magnetic particle break 37 is automatically activated so as to increase the viscosity of the magnetic particles, thereby retarding rotation of spindle 21, and altering (slowing) the rate at which fiber 7 pays-out from bulk supply spool 9. As this occurs, dancer assembly 29 is activated such that dancer arm 50 pivots about pivot pin 68 toward spindle 21. At the same time, dancer arm spring 57 is biased between dancer spring clasp 53 on dancer arm 50 and adjust rod 82 in spring adjustment assembly 60. This mechanism acts to increase the tension in fiber 7 paying-out from the associated bulk supply spool 9. Once the tension in fiber 7 is at or above the predetermined magnitude, as measured by load cell transducer 93, electronic control means 99 reduces the viscosity of the magnetic particles in magnetic particle brake 37, thus releasing spindle 21 to continue to rotate and pay-out fiber from bulk supply spool 9. As this occurs, dancer assembly 29 returns to its preactivation setting. Thus, each individual fiber 7 is monitored, and its tension controlled independent of the tension state in adjacent fibers and spindle assemblies. It will be understood that dancer spring 57 can be prebiased by rotation of thumb knob 84 so as to extend or to retract adjustment rod 82. In this way, fine adjustment of the tension in fiber 7 may be accomplished with the present invention.

It is to be understood that the present invention is by no means limited only to the particular constructions herein disclosed and shown in the drawings, but also comprises any modifications or equivalents within the scope of the claims.

What is claimed is:

1. A multi-spindle fiber pay-out apparatus providing fiber tension control comprising:

a frame supporting a plurality of spools of fiber wherein each spool of fiber is mounted on a spindle having a first end and a second end, said first end being in rotational supporting relation to said spool of fiber and said second end being operatively engaged with a magnetic particle brake;

a fiber take-up system mounted upon said frame in cooperative relation to said spool of fiber and arranged so as to compensate for changes in fiber pay-out rate from said spool of fiber caused by activation of said magnetic particle brake; and a load cell transducer mounted on said frame adjacent to said fiber take-up system, at least partially engaged by said fiber, and in electrical data communication with said magnetic particle brake so as to (i) activate said magnetic particle brake when a tension in said fiber is detected below a predetermined magnitude, and (ii) deactivate said magnetic particle brake when said tension in said fiber is at or above said predetermined magnitude.

2. A multi-spindle fiber pay-out apparatus according to claim 1 wherein said fiber take-up system comprises a plurality of guide rollers arranged adjacent to said spool of fiber so as to allow for a double threading of said fiber between said plurality of guide rollers and a biased fiber tensioning assembly.

3. A multi-spindle fiber pay-out apparatus according to claim 2 wherein said load cell transducer includes a rotatingly mounted transducer guide roller arranged in spaced coplanar relation to at least one of said plurality of guide rollers in said fiber take-up system.

4. A multi-spindle fiber pay-out apparatus according to claim 3 wherein said fiber engages no more than a 90° segment of said transducer guide roller.

5. A multi-spindle fiber pay-out apparatus according to claim 2 wherein said biased fiber tensioning assembly comprises a biased pivot arm having an elongate shaft mounted at a first end and a pair of sheaves rotatingly mounted to a second end of said shaft wherein said sheaves each guidingly engage said fiber.

6. A method for monitoring and adjusting tension in a fiber comprising:

(A) paying-out a continuous length of fiber so as to continuously engage a rotating portion of a load cell transducer;

(B) comparing the magnitude of a load applied to said load cell transducer by said fiber to a standard;

(C) activating a magnetic particle brake so as to retard the pay-out of fiber when said load is detected below said standard; and (D) deactivating said magnetic particle brake when said load is at or above said standard.

7. A multi-spindle fiber pay-out apparatus providing fiber tension control comprising:

a frame supporting a plurality of spools of fiber wherein each spool of fiber is mounted on a spindle having a first end and a second end, said first end being in rotational supporting relation to said spool of fiber and said second end being operatively engaged with a magnetic particle brake;

a plurality of guide rollers arranged adjacent to said spool of fiber so as to allow for a double threading of said fiber between said plurality of guide rollers and a biased pivot arm having an elongate shaft mounted at a first end and a pair of sheaves rotatingly mounted to a second end of said shaft wherein said sheaves each guidingly engage said fiber, said guide rollers and said biased pivot arm being mounted upon said frame in cooperative relation to said spool of fiber and arranged so as to compensate for changes in fiber pay-out rate from said spool of fiber caused by activation of said magnetic particle brake; and a load cell transducer assembly including a sheave, said assembly being (i) mounted on said frame adjacent to at least one of said guide rollers so that said sheave is at least partially engaged by said fiber, and (ii) in operative control of said magnetic particle brake so as to (i) activate said magnetic particle brake when a load in said fiber is detected below a predetermined standard, and (ii) deactivate said magnetic particle brake when said load in said fiber is at or above said predetermined standard.

8. A multi-spindle fiber pay-out apparatus providing fiber tension control comprising, in combination:

a frame supporting a plurality of spools of fiber wherein each spool of fiber is mounted on a spindle having a first end and a second end, said first end being in rotational supporting relation to said spool of fiber and said second end being operatively engaged with a magnetic particle brake;

a fiber take-up system mounted upon said frame in cooperative relation to said spool of fiber and arranged so as to compensate for changes in fiber pay-out rate from said spool of fiber caused by activation of said magnetic particle brake; and a load cell transducer mounted on said frame adjacent to said fiber take-up system, at least partially engaged; by said fiber, and in data and operative control communication with;

(a) control board comprising a power conversion section, load cell amplification section, and a control regulation section, and (b) said magnetic particle brake so as to (i) activate said magnetic particle brake when a tension in said fiber is detected below a predetermined magnitude, and (ii) deactivate said magnetic particle brake when said tension in said fiber is at or above said predetermined magnitude.

9. A multi-spindle fiber pay-out apparatus according to claim 8 wherein said power conversion section provides input power to said magnetic particle brake, and reduces voltage for said load cell amplification section and said control regulation section.

10. A multi-spindle fiber pay-out apparatus according to claim 8 wherein said load cell amplification section provides 40 to 450 millivolts voltage levels to said load cell transducer.

11. A multi-spindle fiber pay-out apparatus according to claim 8 wherein said load cell amplification section receives input data from said load cell transducer and increases said 40 to 450 millivolt voltage levels to +/−5 volts DC level signals for use by said control regulation section.

12. A multi-spindle fiber pay-out apparatus according to claim 8 wherein said control regulation section compares a standard tension setpoint equal to said predetermined magnitude in said fiber against an actual tension applied to said load cell transducer by said fiber and communicates an adjustment in a power level to said magnetic particle brake.

13. A multi-spindle fiber pay-out apparatus according to claim 12 wherein said tension setpoint is input to said control regulation section by an external potentiometer.

14. A multi-spindle fiber pay-out apparatus according to claim 13 wherein said actual tension in said fiber is communicated to said control regulation section via said load cell amplification section by said load cell transducer.

15. A multi-spindle fiber pay-out apparatus according to claim 13 wherein said control regulation section comprises a plurality of potentiometers that regulate the magnitude of said adjustments made to power delivered to said magnetic particle brake.

16. A multi-spindle fiber pay-out apparatus according to claim 8 wherein said control regulation section provides a means for calibrating said load cell transducer.

17. A multi-spindle fiber pay-out apparatus according to claim 8 wherein said control regulation section includes four status indicators.

18. A method for monitoring and adjusting tension in a fiber comprising:

(A) paying-out a continuous length of fiber from a bulk supply spool so as to continuously engage a portion of a load cell transducer;

(B) comparing the magnitude of a load applied to said load cell transducer by said fiber to a standard;

(C) providing power to a magnetic particle brake so as to retard the pay-out of fiber from said bulk supply spool when said load is detected below said standard; and (D) stopping the provision of power to said magnetic particle brake when said load is at or above said standard.

* * * * *